US009422138B2

(12) United States Patent
Lappalainen

(10) Patent No.: US 9,422,138 B2
(45) Date of Patent: Aug. 23, 2016

(54) ARRANGEMENT FOR DAMPING OSCILLATION OF LOADING MEMBER IN CRANE

(75) Inventor: Jani Lappalainen, Turenki (FI)

(73) Assignee: KONECRANES GLOBAL CORPORATION, Hyvinkää (FI)

( * ) Notice: Subject to any disclaimer, the term of this patent is extended or adjusted under 35 U.S.C. 154(b) by 212 days.

(21) Appl. No.: 14/000,903

(22) PCT Filed: Mar. 19, 2012

(86) PCT No.: PCT/FI2012/050256

§ 371 (c)(1),
(2), (4) Date: Aug. 22, 2013

(87) PCT Pub. No.: WO2012/131154

PCT Pub. Date: Oct. 4, 2012

(65) Prior Publication Data

US 2013/0334157 A1 Dec. 19, 2013

(30) Foreign Application Priority Data

Mar. 25, 2011 (FI) ..... 20115289

(51) Int. Cl.
*B66C 13/06* (2006.01)

(52) U.S. Cl.
CPC ..... *B66C 13/06* (2013.01)

(58) Field of Classification Search
CPC ..... B66C 13/04; B66C 13/06; B66C 13/063; B66C 13/085; B66C 13/10; B66C 13/105; B66C 13/23; B66C 15/04; B66C 15/045
See application file for complete search history.

(56) References Cited

U.S. PATENT DOCUMENTS 840,807 A * 1/1907 Shem ..... B66F 9/07545 212/334
1,487,032 A * 3/1924 Shutt ..... B66C 13/00 164/405
3,598,440 A * 8/1971 Ramsden ..... B66C 1/101 212/274
3,702,124 A * 11/1972 Highland ..... B61B 7/06 104/112

(Continued)

FOREIGN PATENT DOCUMENTS

DE 1207578 B 12/1965
DE 1271942 B 7/1968

(Continued)

*Primary Examiner* — Emmanuel M Marcelo
*Assistant Examiner* — Michael Gallion
(74) *Attorney, Agent, or Firm* — Birch, Stewart, Kolasch & Birch, LLP

(57) ABSTRACT

An arrangement for damping oscillation of a loading member in a crane includes a trolley, a hoisting mechanism, hoisting ropes, and a loading member. The arrangement includes a vertical guide projection arranged in an upper part of the loading member, and a guide part arranged in the trolley and receiving the guide projection. Damping members connected to the guide part are arranged in a separate support frame which is guidable into its place in a dock arranged underneath the trolley and which is lowerable off the dock onto the loading member. The guide part is a floating guide tube structure. The damping members include a plurality of side damping modules connected between a side wall of the guide tube structure and the support frame for substantially damping horizontal movement of the guide tube structure. A support joint is arranged in an upper part of the support frame.

20 Claims, 10 Drawing Sheets

(56) References Cited

U.S. PATENT DOCUMENTS 3,788,491 A * 1/1974 Stone ..... B66D 3/18 104/178
3,820,663 A * 6/1974 Junes et al. ..... B66C 1/36 212/99
3,887,080 A * 6/1975 Wilson ..... B66C 11/02 212/274
5,165,556 A 11/1992 Karhunen
5,219,420 A 6/1993 Kiiski et al.
5,257,891 A * 11/1993 Baumann ..... B66C 1/101 212/274
5,297,654 A * 3/1994 De Forges De Parny ..... H02G 1/02 182/142
5,392,935 A * 2/1995 Kazama ..... B66C 13/063 212/276
5,769,250 A * 6/1998 Jussila ..... B66C 13/08 212/274
6,431,379 B1 * 8/2002 Kroll ..... B66C 1/101 212/319
6,921,061 B2 * 7/2005 Hayashi ..... F21V 21/38 254/278
6,962,091 B2 * 11/2005 Lukas ..... B66C 13/063 212/276
7,210,589 B2 * 5/2007 Iizuka ..... B66C 13/06 212/270
7,287,740 B2 10/2007 Reyes et al.
7,328,812 B2 * 2/2008 Nakao ..... B66C 1/28 212/330
7,424,998 B1 * 9/2008 Barney ..... B66C 17/00 254/329
7,845,284 B2 * 12/2010 Izumi ..... B65G 17/20 104/88.02
8,231,324 B2 * 7/2012 Yoshida ..... B65G 1/0407 414/280
8,490,802 B2 * 7/2013 Honda ..... B66C 11/04 212/330
8,757,401 B2 * 6/2014 Uchino ..... H01L 21/67733 212/331
8,790,061 B2 * 7/2014 Yamashita ..... B65G 1/0492 414/280
2004/0026349 A1 * 2/2004 Colgate ..... B66D 3/18 212/284
2004/0253087 A1 * 12/2004 Iizuka ..... B66C 13/06 414/626
2006/0237525 A1 * 10/2006 Sone ..... H01L 21/67294 235/375
2006/0245862 A1 * 11/2006 Hansl ..... B65G 1/0435 414/281
2007/0059131 A1 * 3/2007 Yoshitaka ..... B65G 37/02 414/217
2008/0092769 A1 * 4/2008 Izumi ..... B65G 17/20 105/148
2008/0168920 A1 * 7/2008 Nakashima ..... B65G 1/0457 104/124
2009/0026780 A1 * 1/2009 Claraz ..... B66C 13/04 294/74
2010/0096353 A1 * 4/2010 Cho ..... B66D 1/26 212/330
2010/0252523 A1 * 10/2010 Kraft ..... B65G 1/0457 212/273
2011/0079678 A1 * 4/2011 Brenner ..... B64C 27/001 244/17.13
2011/0240583 A1 * 10/2011 Franzen ..... B66C 19/002 212/318

FOREIGN PATENT DOCUMENTS

| | | | | |
|---|---|---|---|---|
| DE | 10105261 | A1 | | 8/2002 |
| GB | 1412248 | | | 10/1975 |
| GB | 1542821 | | | 3/1979 |
| JP | 52-43249 | | | 4/1977 |
| JP | 52043249 | A | * | 4/1977 |
| JP | 61-28777 | U | | 2/1986 |
| JP | 1-76889 | U | | 5/1989 |
| JP | 1-118983 | U | | 8/1989 |
| JP | 7-33384 | A | | 2/1995 |
| JP | 8-268682 | A | | 10/1996 |
| JP | 2004-75233 | A | | 3/2004 |
| KR | 2001-0057393 | A | | 7/2001 |
| KR | 2002-0011599 | A | | 2/2002 |
| SU | 502830 | | | 2/1976 |
| SU | 1377239 | A1 | | 2/1988 |

* cited by examiner

ARRANGEMENT FOR DAMPING OSCILLATION OF LOADING MEMBER IN CRANE

BACKGROUND OF THE INVENTION

The invention relates to an arrangement for damping oscillation of a loading member in a crane comprising a trolley, a hoisting mechanism provided in the trolley, hoisting ropes suspended from the hoisting mechanism, a loading member fastened to the hoisting ropes, the arrangement for damping oscillation of a loading member comprising a vertical guide projection arranged in an upper part of the loading member, and damping members arranged in the trolley and including a guide part receiving the guide projection of the loading member.

Acceleration and deceleration of a crane are mainly responsible for oscillations of a loading member of the crane. This oscillation may be minimized by driving the crane at a constant speed or sufficiently slowly. Research abounds for damping or eliminating oscillations of a loading member of a crane and a load fastened thereto by using various computer programs or speed control methods, e.g. in U.S. Pat. No. 5,219,420. In some cases, particularly in container cranes, oscillation has been suppressed by means of auxiliary ropes and auxiliary drums, cf. for instance U.S. Pat. Nos. 5,769,250 and 7,287,740 as well as DE Patent 1207578. In many applications also pneumatic or hydraulic dampers are used, cf. for instance GB Patent 1542821. However, when using process cranes in connection with heavy loads, such as vacuum hoists including loading members suspended therefrom, the cranes have to be driven at high speeds required by the course of the process. When the commodity to be moved is then e.g. paper or a corresponding product, it is at high risk of being damaged if the liquids used in the crane leak to the product being moved.

U.S. Pat. No. 5,165,556, in turn, describes a device for damping oscillation of a loading member, comprising downward-pointing brackets attached to the bottom of a trolley. A load is lifted in place between these brackets, and the load is retained rigidly in place while driving the crane, whereby oscillation of the loading member and the load attached thereto is prevented. Such damping systems are expensive, and they require a lot of material and space. The damping of this type has a further disadvantage in that when the loading member is lifted at a high speed between the brackets, a gap formed by the brackets for the loading member has to be wide, which may lead to post-oscillations between the brackets. When the loading member has then been supported rigidly between the brackets, accelerations of the trolley directly influence the load attached to the hoisting member. This may lead to malfunction or increased risk of collision, particularly when handling large paper rolls, for instance, when the rolls are kept in place by means of a vacuum hoist.

From JP 08268682 A and KR 20010057393 A, centering of a loading member to a trolley of a crane by means of conical surfaces is known. Therein, a conical loading member centering piece is mounted immovably in the trolley. In the first-mentioned publication, the conical surface of the loading member simultaneously serves as a damper.

DE 10105261 A1 also discloses centering and interlocking means between a loading member and a trolley as well as vertical damping means provided in the trolley for damping a centering event.

In SU 502830 A1, a load is lifted into a tube downwardly extending from a trolley, wherein the load is supported laterally in the tube by means of suspended wheels provided at ends of lever arms.

SUMMARY OF THE INVENTION

An object of the invention is to eliminate the disadvantages of the above-described prior art and to provide an advantageous solution to the problem. This object is achieved by an arrangement according to the invention, which is mainly characterized in that the damping means are arranged in a separate support frame which, in a hoisting direction of the loading member, is guidable into its place in a dock arranged underneath the trolley and which is lowerable off the dock, onto the loading member, the guide part is a floating guide tube structure, the damping members comprising a plurality of side damping modules connected between a side wall of the guide tube structure and the support frame, around the guide tube structure, for substantially damping horizontal movement of the guide tube structure, and a joint which is arranged in an upper part of the support frame and from which the guide tube structure is suspended.

Compared with previous solutions, the solution according to the invention takes little space and it may be installed between hoisting ropes located about one meter apart from one another. The arrangement may be applied in connection with various loading members since its guide projection is mounted at the centre of the loading member. The arrangement may be implemented by a simple welded structure wherein the number of various fastening members may be minimized. The structure is modular, enabling its components to be changed as necessary and required. The loading member may be lifted at a high speed to the guide tube structure. The elasticity of the damping arrangement reduces stresses of the trolley and makes loads safer to hoist and transport. The support frame is easy to detach from the dock and lower onto the loading member for service, for instance. Consequently, no service plane as such has to be provided in the trolley for the damping arrangement, either.

LIST OF FIGURES

The invention is now be described in closer detail by means of its preferred embodiments and with reference to the accompanying drawings, in which.

DETAILED DESCRIPTION OF THE INVENTION

Figure 1:
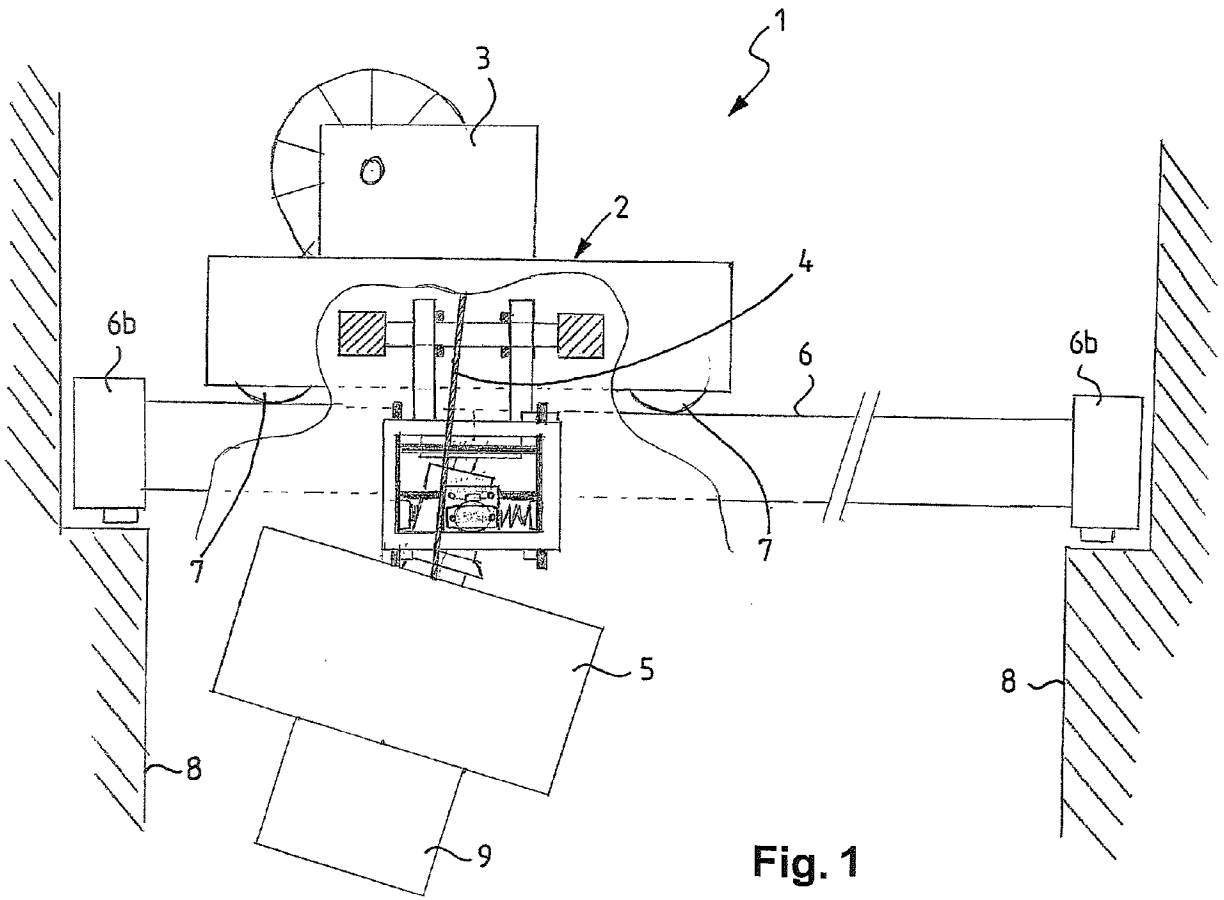
FIG. 1 is a side view showing a crane and an arrangement according to the invention when the crane starts moving or accelerates to the right.
Figure 2:
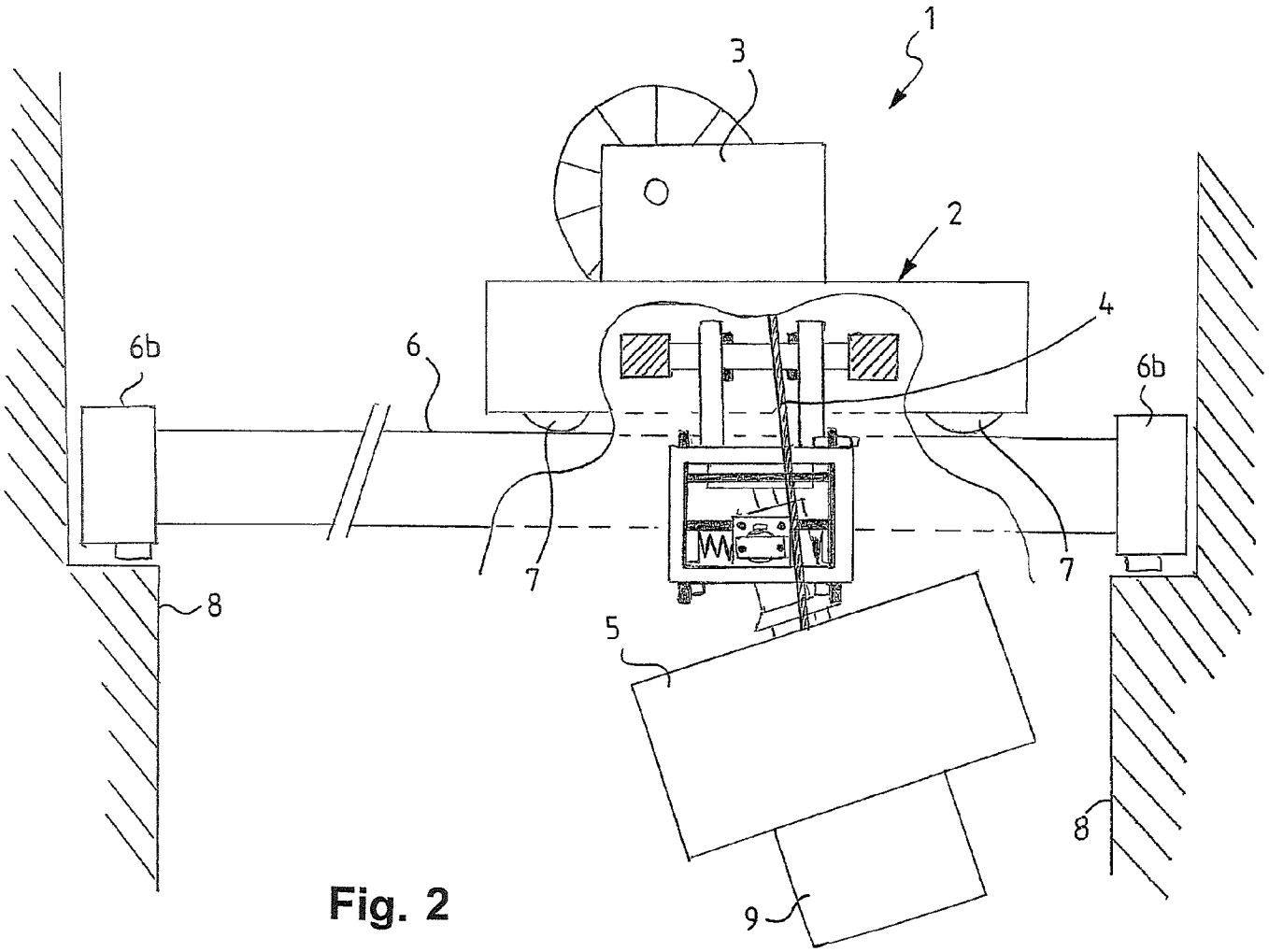
FIG. 2 is a side view showing a crane and the arrangement according to the invention when the crane further moves to the right but starts to decelerate or stop.

First referring to FIGS. 1 and 2, a crane 1 is shown which is provided with an arrangement according to the invention for damping oscillation of a loading member 5. The crane 1 comprises a trolley 2, a hoisting mechanism 3 arranged in the trolley 2, hoisting ropes 4 suspended from the hoisting mechanism 3, and the loading member 5 fastened to the hoisting ropes 4. Resting on its wheels 7, the trolley 2 moves along end supports 6 of the crane 1. The end supports 6 are connected to ends 6*b* of the crane 1, the ends 6*b* in turn moving along load-bearing structures 8 of a site of the crane 1. A load attached to the loading member 5 is designated by reference number 9. The loading member 5 shown herein is typically a vacuum hoist.

Referring further to the rest of the figures of the drawings, the arrangement for damping oscillation of the loading member 5 and, depending on the load of the loading member 5, also of the load 9 fastened thereto, comprises a vertical guide projection 10; 110 arranged in an upper part of the loading member 5 and damping members (to be described next) arranged in the trolley 2 and including as one part a guide part 11; 110 for receiving the guide projection 10; 100 of the loading member 5.

One essential feature of the invention is that the damping means are arranged in a separate support frame 12 guidable in a hoisting direction of the hoisting member 5 into its place in a dock 13 arranged underneath the trolley 2 and lowerable off the dock 13, onto the loading member 5.

It is also essential that the guide part 11; 110 is a floating guide tube structure 11; 110, whereby the damping members comprise a plurality of side damping modules 14 connected between a side wall of the guide tube structure 11; 110 and the support frame 12, around the guide tube structure 11; 110 for substantially damping horizontal movement of the guide tube structure 11; 110, and a support joint 15; 150; 350; 450 which is arranged in an upper part of the support frame 12 and which is advantageously damped and from which the guide tube structure 11; 110 is suspended.

A horizontal position of at least one of the support frame 12 and the dock 13 is adjustable so as to enable the guide projection 10; 110 and the guide tube structure 11; 110 to be brought into the same vertical line.

Preferably, the dock 13 is fastened to a support framework 36 provided between two transverse load beams 16 of the trolley 2, wherein the position of the dock 13 is adjustable in the longitudinal and transverse direction of the trolley 2.

Figure 15:
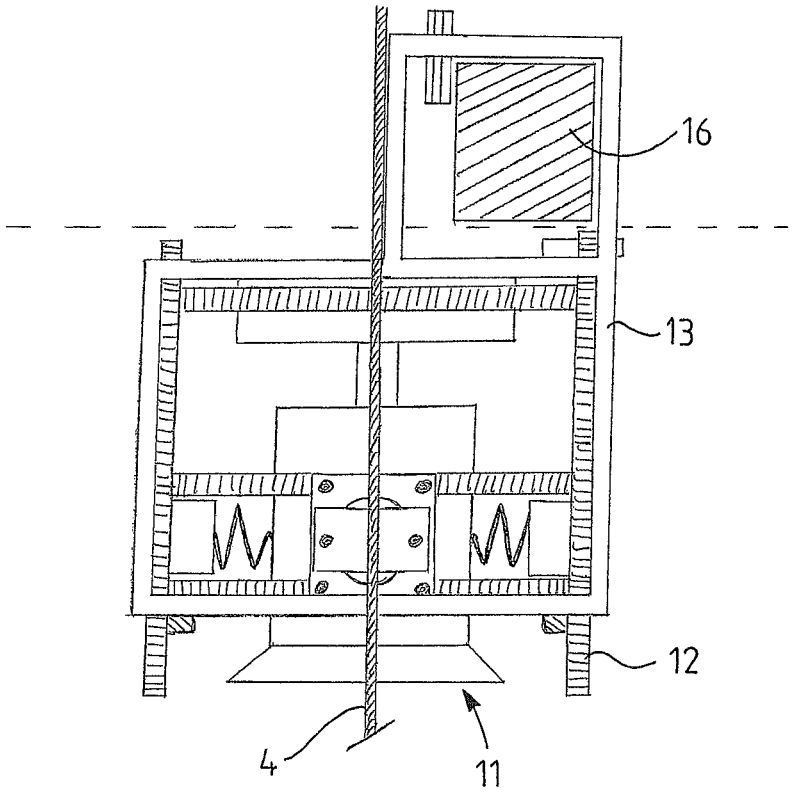
FIG. 15 shows an alternative for fastening a dock to a trolley.

Alternatively, according to FIG. 15, the dock 13 is fastened to one transverse load beam 16 of the trolley 2, wherein the position of the dock 13 is adjustable also in those directions. Also the support frame 12 may in the dock 13 be adjustable in the longitudinal direction of the trolley 2 along rails (not shown) appropriately arranged in the dock 13, for instance.

The dock 13 is provided with vertical slide bars 17 and the support frame 12 is provided with slide blocks 18 in cooperation therewith for lowering the support frame 12 from the dock 13 and for guiding it back in to the dock 13. Consequently, the support frame 12 is at its lower part further provided with bottom stoppers 19 abutting against the lower part of the dock 13 for restricting the upward movement thereof, and interlocking devices 20 clamping an upper part of the dock 13 for fastening the support frame 12 to the dock 13.

Figure 5:
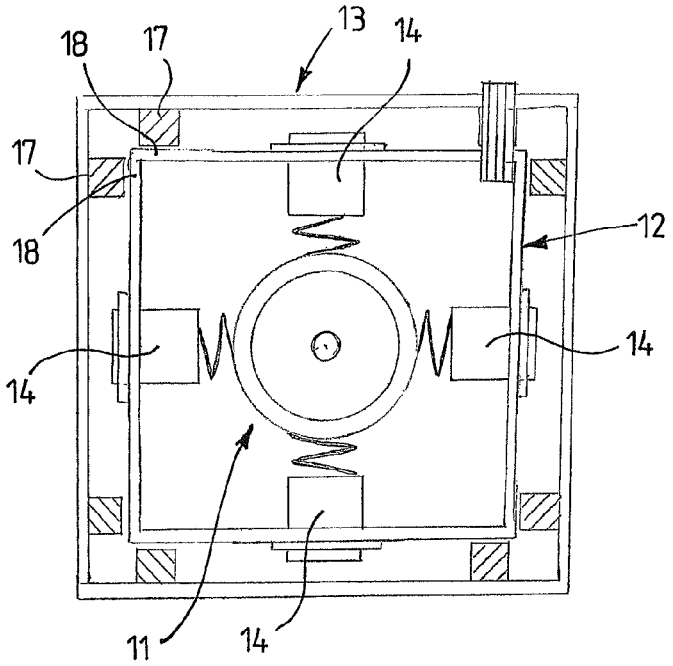
FIG. 5 shows a dock and a support frame as seen from below.
Figure 6:
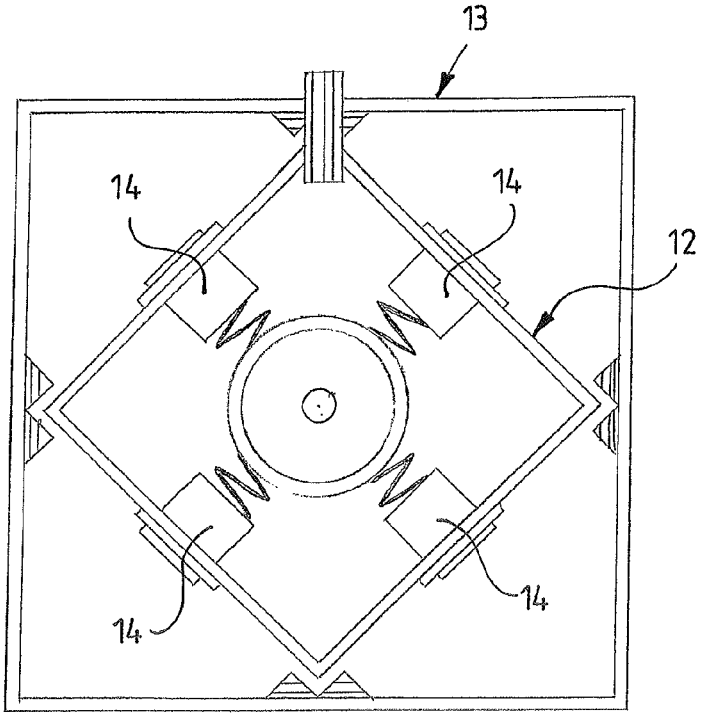
FIG. 6 shows another embodiment of a dock and a support frame as seen from below.

In the described examples, the support frame 12 and the dock 13, when viewed from above, are rectangular structures, so when arranged one within the other, they may be located such that their sides are parallel, as in FIG. 5, or such that the corners of the support frame 12 reside at the centre of the sides of the dock 13, as in FIG. 6. The solution according to FIG. 5 saves space but in the solution according to FIG. 6 the side damping modules 14 may be easier to arrange. The support frame 12 and the dock 13 are herein described as an open "lattice structure", but closed or partly closed box structures are also possible.

Figure 3:
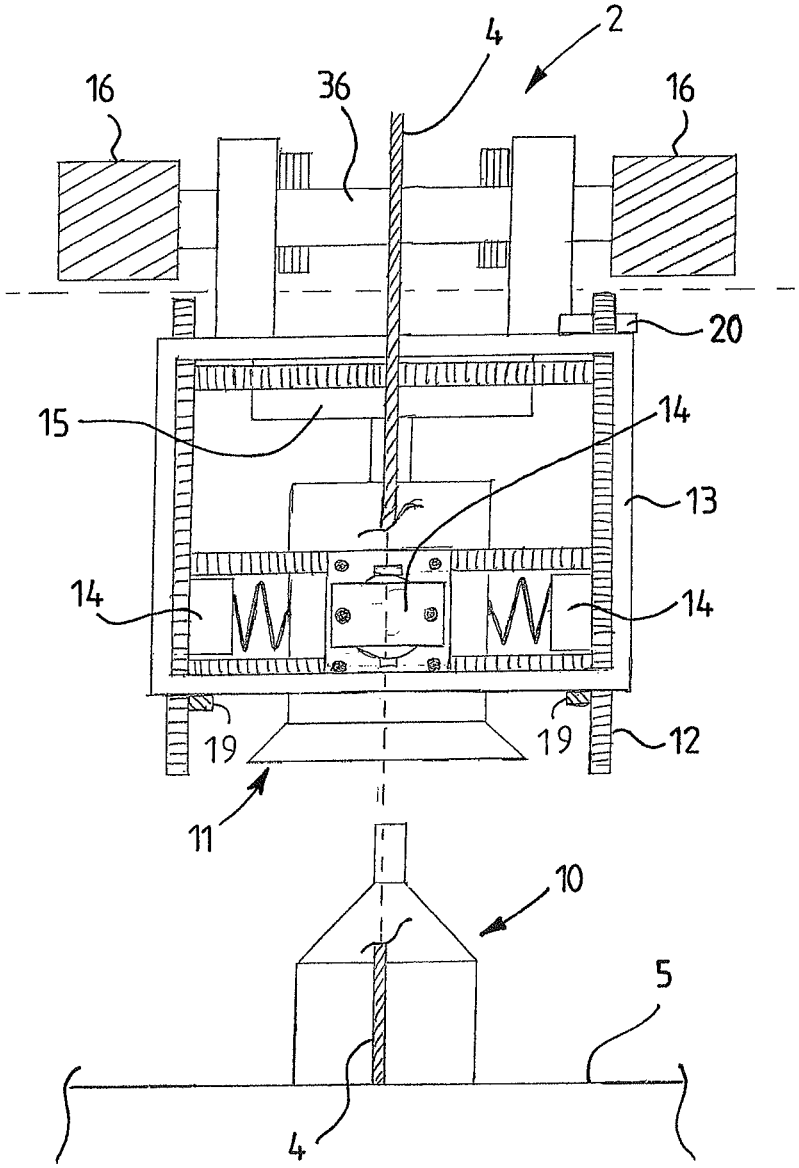
FIG. 3 shows the arrangement according to FIGS. 1 and 2 on a larger scale.
Figure 4:
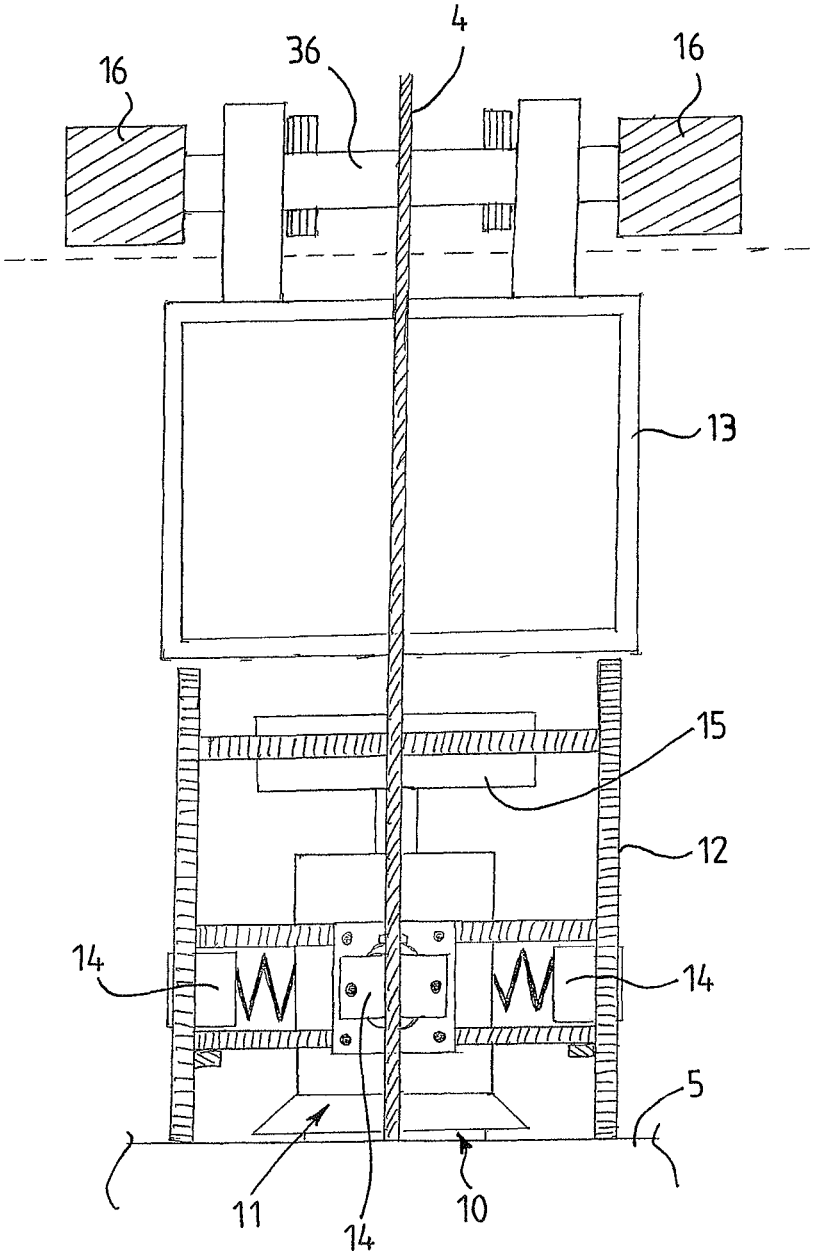
FIG. 4 shows the arrangement according to FIG. 3 but with a support frame of damping members being lowered onto a loading member.
Figure 7:
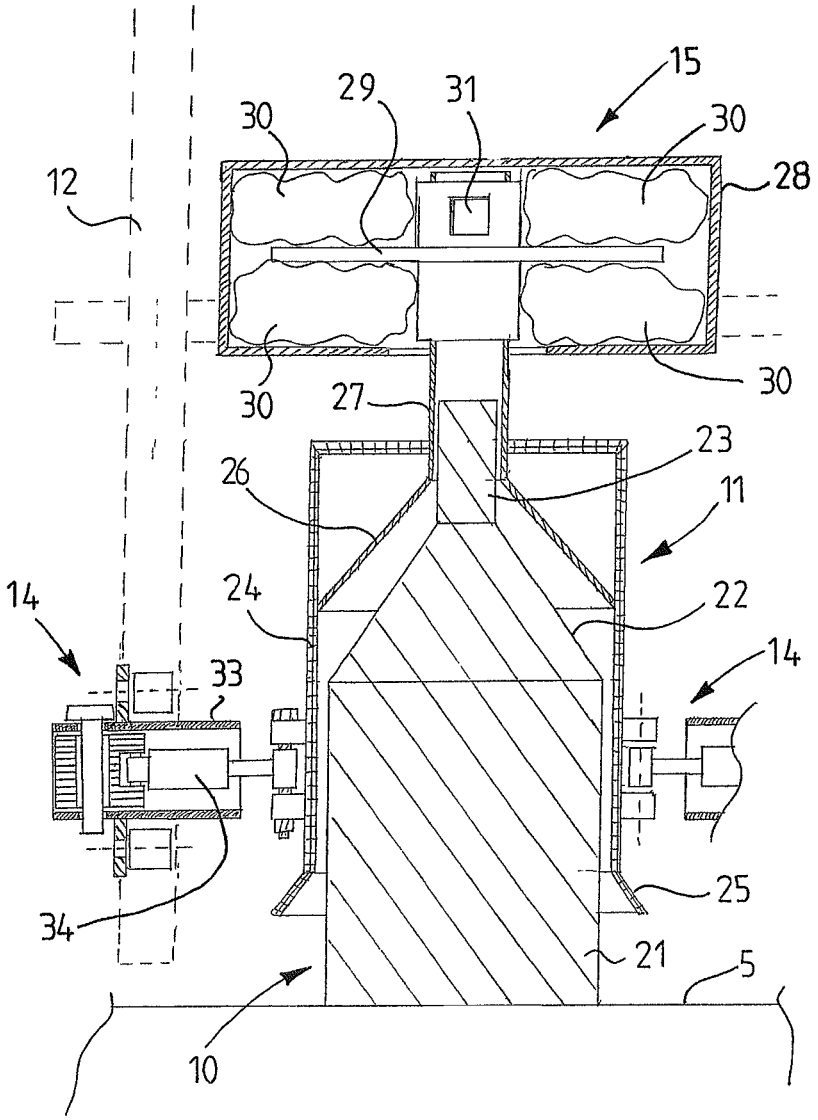
FIG. 7 shows damping members in closer detail.
Figure 8:
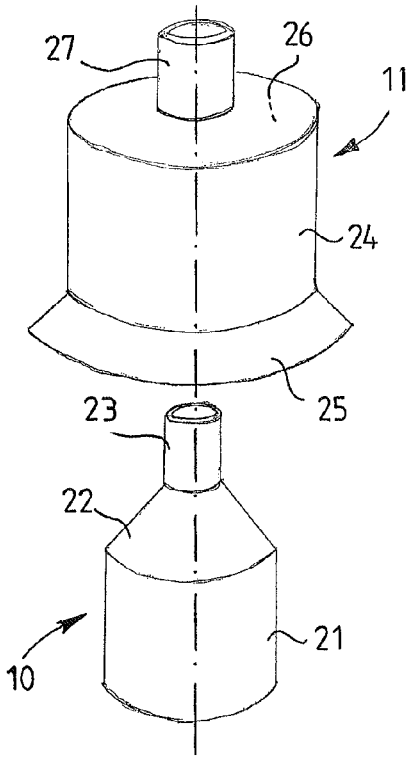
FIG. 8 is a perspective view showing an implementation of a guide projection of a loading member and a guide part receiving the same.

Referring to FIGS. 3, 7, and 8 in particular, the guide projection 10 comprises an end projection 21 whose lower end is fastened to the loading member 5, between two hoisting ropes 4, a tapering projection guide surface 22 protruding upwards from an upper end of the end projection 21, and a guide pin 23 which extends upwards from this projection guide surface 22 and whose diameter is considerably smaller than the diameter of the end projection 21. Similarly, the guide tube structure 11 comprises an end tube 24 guide projection 10 for receiving the end projection 21, whereby a downwards expanding guide hem 25 extends from a lower edge of the end tube 24 and whereby an upper end of the end tube 24 is provided with an upwards tapering inner guide surface 26 and an upper tube 27 which extends upwards from the inner guide surface 26 and receives the guide pin 23 and into which the guide pin 23 of the guide projection 10 fits with a loose fitting.

Most preferably, the end projection 21 and the guide pin 23 of the guide projection 10 as well as the end tube 24 and the upper tube 27 of the guide tube structure 11 are cylindrical while the projection guide surface 22, the guide hem 25 and the inner guide surface 27 are conical.

Figure 9:
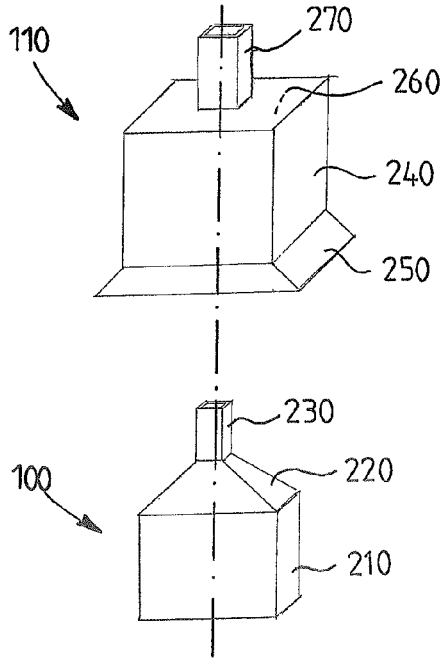
FIG. 9 is a perspective view showing another implementation of a guide projection of a loading member and a guide part receiving the same.

Alternatively, according to FIG. 9, an end projection 210 and a guide pin 230 of a guide projection 100 as well as an end tube 240 and an upper tube 270 of a guide tube structure 110 may have an angular, preferably square, cross-section, while a projection guide surface 220, a guide hem 250 and an inner guide surface 260 are angular cones.

In the structure shown in FIG. 7, the support joint 15 connected to the upper tube 27 of the guide tube structure 11 is arranged in a damping chamber 28 provided in the upper part of the support frame 12, the support joint 15 comprising a support structure 29, such as a plate-sleeve structure shown in the figure, arranged around the upper tube 27 of the guide tube structure 11, and vertical damping elements 30 which are made of an appropriate elastic yet sufficiently robust material capable of carrying the entire guide tube structure 11 floatingly and which are arranged in the damping chamber 28, above and under the support structure 29. In order to ensure that the guide tube structure 11 and the support structure 29 stay in the position designed therefor, an upper end of the upper tube 27 may be provided with a through hole 31 capable of receiving a suitable retainer pin (not shown).

Figure 10:
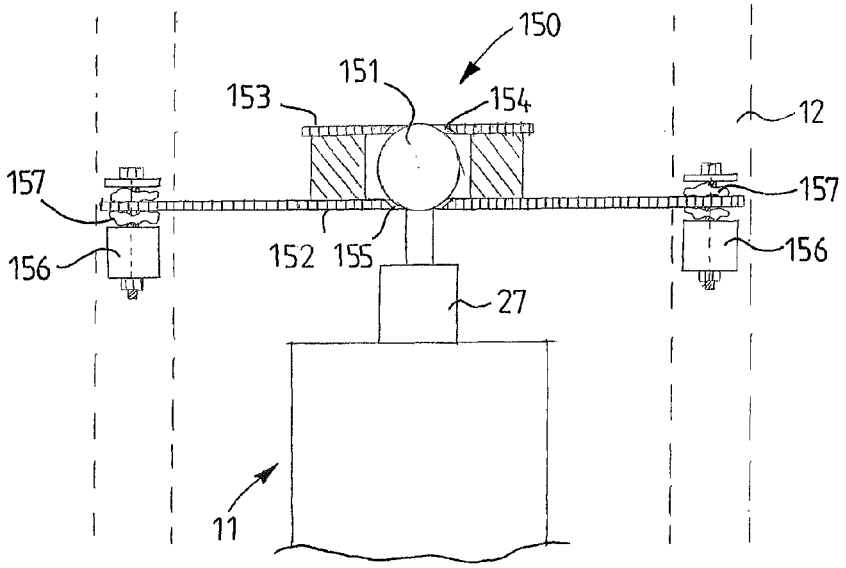
FIG. 10 shows an alternative support joint of a guide tube structure.

FIG. 10 shows a simpler support joint 150 comprising a ball joint 151 fastened to the upper end of the upper tube 27 of the guide tube structure 11. The ball joint 151 is supported against the support frame 12 by means of interlocking plates 152 and 153 provided above and below it. The interlocking plates 152 and 153 are provided with incisions 154 and 155 for the ball joint 150. In order to provide the guide tube structure 11 with vertical elasticity, a vertical damping material 157 is applied between the support frame 12, the lower interlocking plate 152 and fastening bolts 156 thereof.

Figure 11:
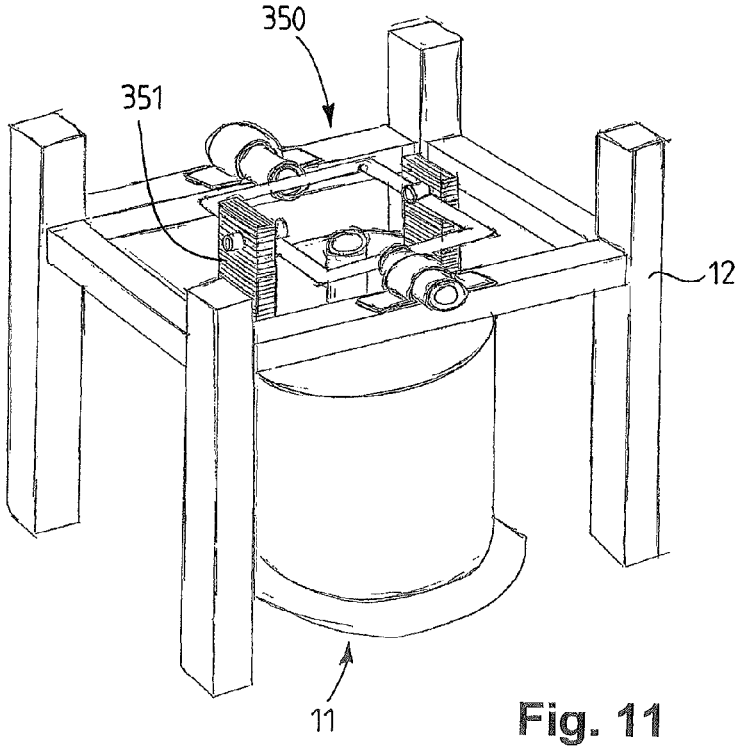
FIG. 11 shows another alternative support joint of a guide tube structure.

FIG. 11 shows another support joint solution comprising a gyroscopic swing 350 including its damping members 351 arranged in an upper end of the guide tube structure 11.

Figure 12:
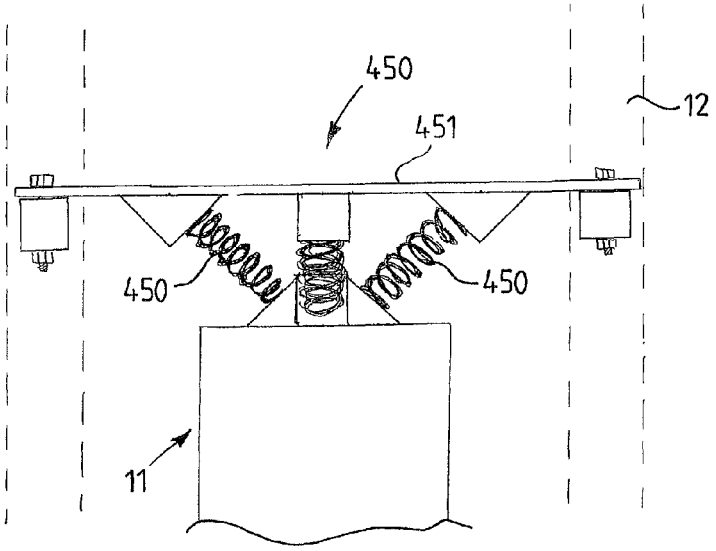
FIG. 12 shows yet another alternative support joint of a guide tube structure.

FIG. 12 shows yet another support joint solution wherein a support plate 451 is mounted in the support frame 12, the support joint comprising helical springs 450 arranged between this support plate 451 and the upper end of the guide tube structure 11.

Figure 13:
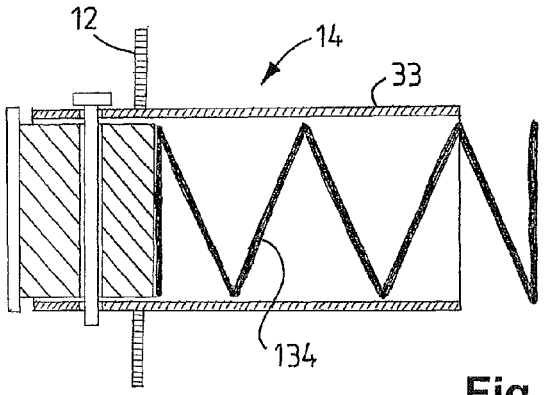
FIG. 13 shows an implementation of a side damping module.
Figure 14:
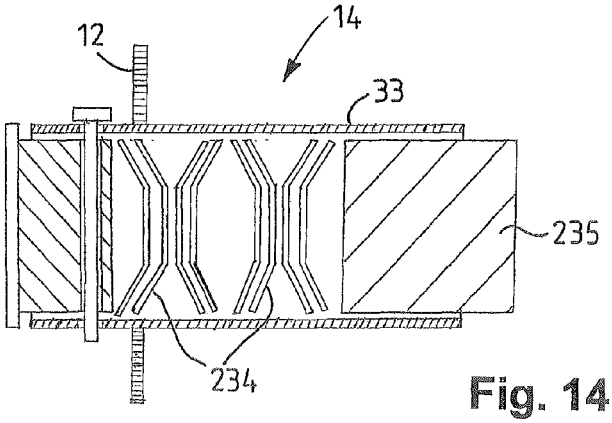
FIG. 14 shows another implementation of a side damping module.

As shown by FIGS. 7, 13, and 14 in particular, the side damping modules 14 comprise a tubular body 33 and at least one elastic element 34, 134 or 234 and 235 mounted therein.

In FIG. 7, the elastic element 34 is shown as a schematic view, in FIG. 13 the elastic element comprises a helical spring 134 (or more if necessary), and in FIG. 14 cup springs 234 and a rubber damper 235. When necessary, these elastic elements may be prestressed.

The described side damping modules 14 may be provided in one or two layers, each layer comprising 3 to 5 such modules. The drawings describe a "single-layer" solution.

The above description of the invention is only intended to illustrate the basic idea of the invention. A person skilled in the art may thus vary its details within the scope of the accompanying claims.

The invention claimed is:

1. An arrangement for damping oscillation of a loading member in a crane, the arrangement comprising:

a trolley;

a hoisting mechanism provided in the trolley;

hoisting ropes suspended from the hoisting mechanism;

a loading member fastened to the hoisting ropes, comprising a vertical guide projection arranged in an upper part of the loading member;

a dock arranged underneath the trolley; and damping members arranged in a separate support frame having a top wall and vertical side walls, the damping members including:

a guide part receiving the guide projection of the loading member, wherein the guide part is a floating guide tube structure;

a plurality of side damping modules connected between a side wall of the guide tube structure and the vertical side walls of the separate support frame, around the guide tube structure, for damping horizontal movement of the guide tube structure; and a support joint coupled to the top wall of the support frame and from which the guide tube structure is suspended in a floating manner, allowing movement of the guide tube structure with respect to the separate support frame, wherein the separate support frame is operable, along a hoisting direction of the hoisting member, between a first position where the separate support frame is housed in the dock and the floating guide tube structure is separated from the guide projection of the loading member, and a second position where the separate support frame along with the damping members are separated from the dock and lowered onto the loading member, and the floating guide tube structure engages with the guide projection of the loading member.

2. The arrangement as claimed in claim 1, wherein a horizontal position of at least one of the support frame and the dock is adjustable so as to enable the guide projection and the guide tube structure to be brought into the same vertical line.

3. The arrangement as claimed in claim 2, wherein the dock is fastened to a support framework provided between two transverse load beams of the trolley, wherein the position of the dock is adjustable in the longitudinal and transverse direction of the trolley.

4. The arrangement as claimed in claim 1, wherein the dock is provided with vertical slide bars and the support frame is provided with slide blocks in co-operation therewith for lowering the support frame from the dock and for guiding it back in to the dock.

5. The arrangement as claimed in claim 1, wherein the guide projection comprises an end projection whose lower end is fastened to the loading member, a tapering projection guide surface protruding upwards from an upper end of the end projection, and a guide pin which extends upwards from this projection guide surface and whose transverse measure is considerably smaller than the transverse measure of the end projection; and in that the guide tube structure comprises an end tube for receiving the end projection of the guide projection, a downwards expanding guide hem extending from a lower edge of the end tube and an upper end of the end tube being provided with an upwards tapering inner guide surface and an upper tube which extends upwards from the inner guide surface and receives the guide pin and into which the guide pin of the guide projection fits with a loose fitting.

6. The arrangement as claimed in claim 5, wherein the end projection and the guide pin of the guide projection as well as the end tube and the upper tube of the guide tube structure are cylindrical while the projection guide surface, the guide hem and the inner guide surface are conical.

7. The arrangement as claimed in claim 5, wherein the end projection and the guide pin of the guide projection as well as the end tube and the upper tube of the guide tube structure are in diameter angular, preferably square, while the projection guide surface, the guide hem and the inner guide surface are angular cones.

8. The arrangement as claimed in claim 1, wherein the support joint is arranged in a damping chamber, the support joint comprising a support structure, such as a plate-sleeve structure, arranged around the upper tube of the guide tube structure, and vertical damping elements arranged in the damping chamber, above and under the support structure.

9. The arrangement as claimed in claim 8, wherein the vertical damping elements comprise an elastic damping material.

10. The arrangement as claimed in claim 1, wherein the support joint comprises a ball joint fastened to an upper end of the guide tube structure.

11. The arrangement as claimed in claim 10, wherein the ball joint is mounted in the support frame by means of vertical damping elements.

12. The arrangement as claimed in claim 1, wherein the support joint comprises a gyroscopic swing arranged in the upper end of the guide tube structure.

13. The arrangement as claimed in claim 1, wherein the support frame is provided with a support plate, the support joint comprising helical springs arranged between this support plate and the upper end of the guide tube structure.

14. The arrangement as claimed in claim 1, wherein the side damping modules comprise a tubular body and at least one elastic element mounted therein.

15. The arrangement as claimed in claim 14, wherein the elastic element comprises a helical spring.

16. The arrangement as claimed in claim 14, wherein the elastic elements are formed by cup springs and rubber dampers.

17. The arrangement as claimed in claim 14, wherein the elastic elements are prestressed.

18. The arrangement as claimed in claim 1, wherein the side damping modules are provided in one or two layers, each layer comprising 3 to 5 such modules.

19. The arrangement as claimed in claim 15, wherein the elastic elements are prestressed.

20. The arrangement as claimed in claim 16, wherein the elastic elements are prestressed.

* * * * *